United States Patent [19]

Takada et al.

[11] Patent Number: 4,481,909

[45] Date of Patent: Nov. 13, 1984

[54] TWO-CYCLE INTERNAL COMBUSTION ENGINE

[75] Inventors: Toshiyuki Takada, Miki; Hitoshi Yamamoto, Hyogo, both of Japan

[73] Assignee: Kawasaki Jukogyo Kabushiki Kaisha, Japan

[21] Appl. No.: 466,783

[22] Filed: Feb. 16, 1983

[30] Foreign Application Priority Data

Feb. 19, 1982 [JP] Japan ..... 57-26387

[51] Int. Cl.[3] ..... F02B 33/14

[52] U.S. Cl. ..... 123/73 CC; 123/73 A; 123/73 CB; 123/73 F; 123/575; 123/432; 123/433; 123/73 R

[58] Field of Search ..... 123/73 AF, 73 CB, 73 CC, 123/73 E, 73 F, 74 AE, 73 R, 74 R, 59 BS, 59 PC, 575, 576, 577, 578, 579, 583, 58[illegible], 257, 267, 433, 432

[56] References Cited

U.S. PATENT DOCUMENTS

Re. 27,367 5/1972 Von Seggeln ..... 123/73 AE 2,032,986 3/1936 Howell et al. ..... 123/267

FOREIGN PATENT DOCUMENTS 2847731 5/1980 Fed. Rep. of Germany ..... 123/433

*Primary Examiner*—Wendell E. Burns

[57] ABSTRACT

A crankchamber precompression type two-cycle internal combustion engine including at least one cylinder assembly, each cylinder assembly including a stepped cylinder constituted by a minor diameter cylinder portion and a major diameter cylinder portion, a stepped piston received in the stepped cylinder and constituted by a minor diameter piston portion and a major diameter piston portion adapted to be fitted in the minor diameter cylinder portion and the major diameter cylinder portion respectively, a crankchamber connected to the major diameter cylinder portion, a working chamber defined between the minor diameter cylinder portion and the minor diameter piston portion, and a sub-intake chamber defined between the major diameter cylinder portion and the minor diameter piston portion. The sub-intake chamber is connected to an auxiliary carburetor set beforehand to form a mixture of fuel of high quality and air, and the crankchamber is connected to a main carburetor set beforehand to form a mixture of fuel of low quality and air. The working chamber is formed, in addition to a main scavenging port communicated with the crankchamber, with an auxiliary scavenging port which is communicated with the sub-intake chamber through a super-charging reservoir.

3 Claims, 2 Drawing Figures

TWO-CYCLE INTERNAL COMBUSTION ENGINE

BACKGROUND OF THE INVENTION

This invention relates to two-cycle internal combustion engines, and more particularly it deals with a crankchamber precompression type two-cycle internal combustion engine.

Generally two-cycle crankchamber precompression type internal combustion engines suffer the disadvantage that they have a higher fuel consumption ratio than four-cycle internal combustion engines and consequently their fuel cost is high, because of a blow-bye phenomenon that occurs during the scavenging stroke and because of a back-blow phenomenon when the engine is of the piston control type intake system.

SUMMARY OF THE INVENTION

This invention has been developed for the purpose of obviating the aforesaid disadvantages of the prior art. Accordingly the invention has as its object the provision of a crankchamber precompression type two-cycle internal combustion engine capable of operation with fuel of low quality, such as kerosene, light oil, etc., to thereby enable fuel cost to be reduced.

The aforesaid object of the invention is accomplished by providing, in a crankchamber precompression type two-cycle internal combustion engine, developed for purposes of effecting exhaust emission control and improving the delivery ratio and scavenging efficiency and disclosed in Japanese patent publication No. Sho-51-44249, at least one cylinder comprising a stepped bore constituted by a minor diameter cylinder portion and a major diameter cylinder portion, at least one stepped piston recieved in the stepped bore of the cylinder and constituted by a minor diameter piston portion and a major diameter piston portion adapted to be fitted in the minor diameter cylinder portion and the major diameter cylinder portion respectively, a working chamber defined between the minor diameter cylinder portion and the minor diameter piston portion, an annular sub-intake chamber defined between the major diameter cylinder portion and the minor diameter piston portion, a crankchamber connected to the major diameter cylinder portion, an auxiliary carburetor connected to the sub-intake chamber through a check valve only allowing a fuel-air mixture to flow toward the sub-intake chamber, main carburetor connected to the crankchamber through a check valve only allowing a fuel-air mixture to flow toward the crankchamber, and a main scavenging passageway connecting the crankchamber with the working chamber, the features that the auxiliary carburetor and the main carburetor are set beforehand in such a manner that the former form a mixture of fuel of high quality and air and the latter form a mixture of fuel of low quality and air, and that the working chambers are each formed with an auxiliary scavenging port in addition to a main scavenging port, the auxiliary scavenging port being maintained in communication with the sub-intake chamber through a super-charging reservoir, with a check valve being mounted between the sub-intake chamber and the super charging reservoir only to allow a fuel-air mixture to flow toward the super-charging reservoir.

DETAILED DESCRIPTION OF THE PREFERRED EMBODIMENT

Figure 1:
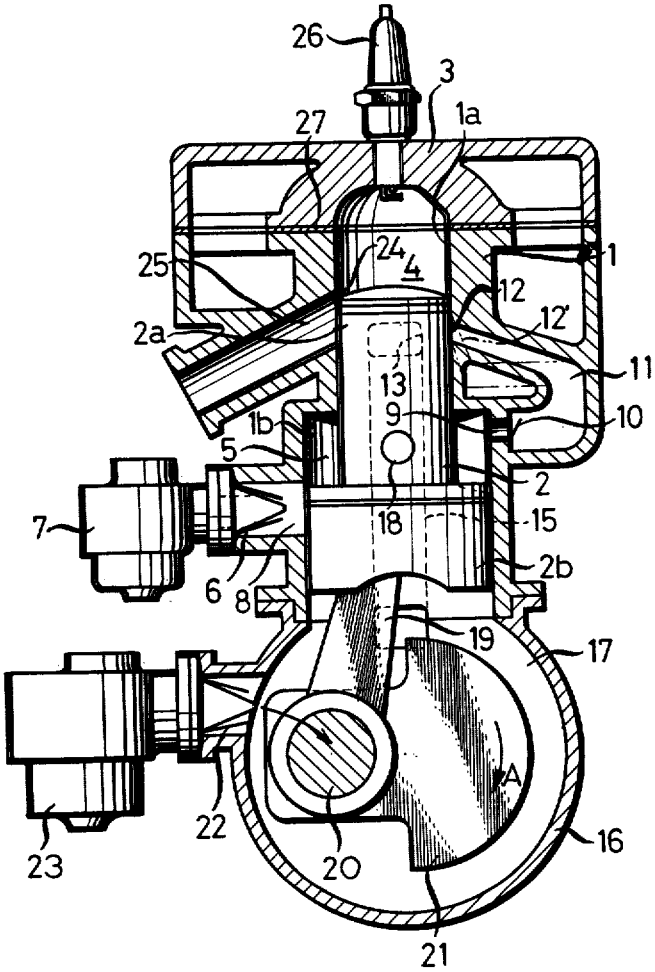
FIG. 1 is a vertical sectional view of the two-cycle internal combustion engine comprising one embodiment of the invention, showing the piston during its upward stroke.

FIG. 1 shows the invention as incorporated in a two-cycle, single cylinder internal combustion engine. A cylinder comprises a minor diameter cylinder portion 1*a* and a major diameter cylinder portion 1*b* arranged vertically and coaxially. Fitted in the cylinder 1 is a piston 2 inserted therein from below and comprising a minor diameter piston portion 2*a* and a major diameter piston portion 2*b* arranged vertically and coaxially. The minor diameter cylinder portion 1*a* and minor diameter piston portion 2*a* cooperate with a cylinder head 3 to define a working chamber 4, and the major diameter cylinder portion 1*b* and the minor diameter piston portion 2*a* cooperate with a shoulder to define an annular sub-intake chamber 5 connected to an auxiliary carburetor 7 for the sub-intake chamber 5 through a check valve 6 in the form of a reed valve only allowing a fuel-air mixture to flow into the sub-intake chamber 5. An air cleaner, not shown, is usually mounted in an upper portion of the carburetor 7. A suction port 8 opens, as shown, in a lower half portion of the sub-intake chamber 5 and is blocked by the major diameter piston portion 2*b* during the upward stroke of the piston 2 to thereby avoid a supercharging pressure in the sub-intake chamber 5 acting on the check valve 6 thereafter. A port 9 formed in an upper portion of a side wall of the sub-intake chamber 5 is connected through a check valve 10 to a super-charging reservoir 11 which is maintained in communication with the working chamber 4 through an auxilliary scavenging port 12 formed in the minor diameter cylinder portion 1*a*. The check valve 10 is in the form of a reed valve and mounted on the super-charging reservoir 11 side of the port 9 only to allow a fuel-air mixture to flow toward the super-charging reservoir 11. The auxiliary scavenging port 12 which is inclined obliquely upwardly with respect to the working chamber 4 as shown is located in a position in which it is opened in the working chamber 4 by the downwardly moving piston 2 simultaneously as a main scavenging port 13 subsequently to be described is opened thereby. The super-charging reservoir 11 has a capacity large enough to hold therein a super-charged mixture of fuel of high quality and air in a pressure condition suiting scavenging after the supercharged mixture is forced thereinto through the check valve 10 from the sub-intake chamber 5 by the upwardly moving piston 2 until the auxiliary scavenging port 12 is opened by the downwardly moving piston 2. As shown, the super-charging reservoir 11 is formed in the wall of the cylinder 1, but the invention is not limited to this specific form of super-charging reservoir 11 and the super charging reservoir 11 may be formed as a separate entity from the cylinder 1 and attached thereto in airtight relation.

The main scavenging port 13, which is similar to that formed in a crankchamber precompression type two-cycle internal combustion engine of the prior art, opens at the minor diameter cylinder portion 1*a* in the working chamber 4 and is connected to a crankchamber 17 in a crank-case 16 through a main scavenging passageway 15 formed in the wall of the cylinder 1. The piston 2 is connected, like that of the prior art, to a crank-web 21 of a crankshaft through a piston pin 18, connecting rod 19 and a crank-pin 20. The crankshaft is rotatably supported by the crank-case 16 through a bearing, not shown. A main carburetor 23 having a main air cleaner, not shown, mounted on the upstream side thereof and functioning to supply a mixture of fuel of low quality (kerosene, light oil, etc., which may include alcohol) and air to the crankchamber 17 is connected to the side wall of the crank-case 16 through a check valve 22 only allowing the mixture to flow toward the crankchamber 17. An exhaust port 24 opening in the working chamber 4 is maintained in communication with the atmosphere through an exhaust passageway 25 and a muffler, not shown. 26 is an ignition plug, and 27 a gasket.

In operation, during the upward stroke of the piston 2 in which the crank-web 21 rotates in the direction of an arrow A in FIG. 1, the mixture of fuel of low quality and air formed in the main carburetor 23 is drawn by suction into the crankchamber 17 through the check valve 22, and during the following downward stroke of the piston 2 the mixture is precompressed in the crankchamber 17 by the piston 2. The precompressed mixture is supplied, as the main scavenging port 13 is opened by the minor diameter piston portion 2*a*, to the working chamber 4 through the main scavenging passageway 15 and main scavenging port 13 to remove the gas of combustion from the working chamber by replacing the same. The mixture supplied to the working chamber 4 is compressed during the next upward stroke of the piston 2 and ignited at a predetermined timing by the ignition plug 26 to explode. The force of explosion is high enough to move the piston 2 downwardly. The aforesaid operation is similar to that of a crankchamber precompression type two-cycle internal combustion engine of the prior art.

The device for supplying a mixture of fuel of high quality and air will be described with emphasis on its operation.

(1) Intake of the mixture into the sub-intake chamber.

Figure 2:
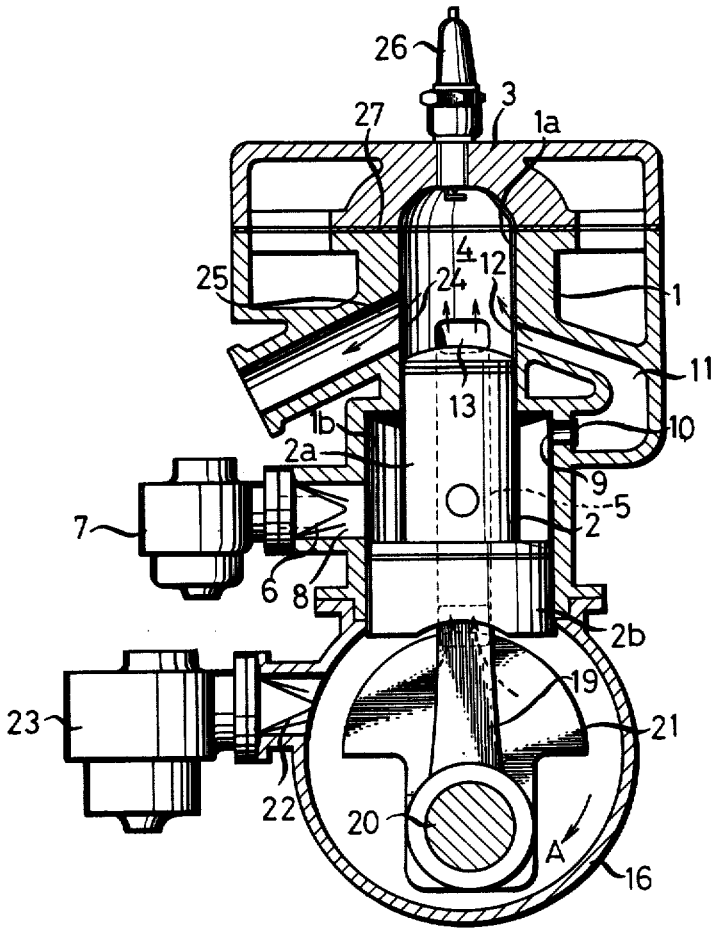
FIG. 2 is a similar view, showing it in a condition in which the piston has moved down to the bottom dead center.

During the downward stroke of the piston 2 as shown in FIG. 2, the mixture of fuel of high quality and air is drawn by suction into the sub-intake chamber 5 through the check valve 6 from the auxiliary carburetor 7 for the sub-intake chamber 5.

(2) Compression and supply under pressure of the mixture in the sub-intake chamber 5 to the super-charging reservoir 11.

As the piston 2 shifts to the upward stroke as shown in FIG. 1, the aforesaid operation of drawing the mixture by suction into the sub-intake chamber 5 is terminated to allow the pressure of the mixture in the sub-intake chamber 5 to rise until it reaches a predetermined level when the check valve 10 opens to allow the mixture to be supplied under pressure to the super-charging reservoir 11. By setting the pressure at which the check valve 10 opens at a level at which the mixture flows from the sub-intake chamber 5 to the super-charging reservoir 11 after the piston 2 blocks the auxiliary scavenging port 12 as shown in FIG. 1, it is possible to allow a mixture of high pressure to be accumulated in the super-charging reservoir 11.

(3) Scavenging by the mixture from the super-charging reservoir 11.

As the piston 2 moves from its top dead center to the downward stroke, the auxiliary scavenging port 12 is opened by the downward moving of the minor diameter piston portion 2*a* to allow the mixture of high pressure accumulated in the super-charging reservoir 11 to be ejected therefrom into a combustion chamber through the auxiliary scavenging port 12 and the working chamber 4, to perform the scavenging by filling the combustion chamber with a fresh supply of mixture. At this time, the mixture of fuel of high quality and air is ejected at high speed from the auxiliary scavenging port 12, so that it is possible to supply a charge of mixture to the vicinity of the spark gap of the ignition plug 26 by selecting a suitable value for the blow-up angle of the auxiliary scavenging port 12. During the compression stroke of the sub-intake chamber 5, a portion of the mixture compressed in the sub-intake chamber 5 may blow-bye through the gap between the minor diameter piston portion 2*a* and the minor diameter cylinder portion 1*a* and the gap between the major diameter piston portion 1*b* and the major diameter cylinder portion 2*b*. The mixture blowing bye in this way serves to cool the piston 2, and particularly when the mixture supplied to the sub-intake chamber 5 contains a lubricant, it facilitates lubrication of the piston 2. Also, when the auxiliary scavenging port 12 is blocked by the minor diameter piston portion 2*a*, the supercharged mixture from the super-charing reservoir 11 may blow-bye through the auxiliary scavenging port 12, into the gap between the piston 2 and cylinder 1. However, since the mixture from the sub-intake chamber 5 enters the gap between the piston 2 and cylinder 1 as described hereinabove, a drop in pressure in the super-charging reservoir 11 can be neglected.

From the foregoing description, it will be appreciated that in the invention the annular sub-intake chamber 5 defined between the stepped cylinder 1 and stepped piston 2 serves as a working chamber of a supply pump for a mixture of fuel of high quality and air, and the supercharged mixture formed in the sub-intake chamber 5 is accumulated in the super-charging reservoir 11 formed in the cylinder 1 to be supplied to the vicinity of the ignition plug 26 in the combustion chamber through the auxiliary scavenging port 12 at a predetermined time. By this arrangement, it is possible to first obtain ignition of the mixture of fuel of high quality and air by means of the ignition plug 26 and then ignite the mixture of fuel of low quality and air supplied to the working chamber 4 through the main scavenging port 13 to allow combustion to be continued. Thus the fuel of high quality may be used in a volume suiting ignition of the mixture and continuation of combustion and operation of the engine can be sustained by using a fuel of low quality. The invention enabling operation of the engine to be continued with a fuel of low quality enables fuel cost to be greatly reduced.

The invention can have application in a two-cycle internal combustion engine having a plurality of cylinders. In applications in which the suction port 8 and the major diameter piston portion 2*b* constituting a piston valve which functions effectively, the check valve 6 can be done without. In this case, the piston valve would function as a "check valve only allowing flow of a mixture to the sub-intake chamber 5". In the embodiment shown and described hereinabove, the auxiliary scavenging port 12 opens toward the upper edge of the exhaust port 24. However, the invention is not limited to this arrangement of the auxiliary scavenging port 12 and it may be curved as indicated by dash-and-dot lines at 12' in FIG. 1 so that it will be directed in a sharp slope toward the spark gap of the ignition plug 26 in the vicinity of the minor diameter cylinder portion 1*a*. In this case, the mixture of fuel of high quality and air compressed in the sub-intake chamber 5 is directly supplied to the vicinity of the ignition plug 26 through the auxiliary scavenging port 12', thereby enabling ignition of the mixture to be obtained positively. Also, the cylinder head 3 may be formed with an inner wall surface of a convex shape in the form of a bowl to define an auxiliary combustion chamber therein in which the spark gap of the ignition plug 26 is located and toward which the auxiliary scavenging port 12' is directed. In this case, the mixture of fuel of high quality and air supplied through the auxiliary scavenging port 12' tends to stay in the auxiliary combustion chamber to enable ignition of the mixture to be obtained with increased positivity.

What is claimed is:

1. A crankchamber precompression type two-cycle internal combustion engine comprising:

at least one cylinder assembly, each cylinder assembly comprising;

a stepped cylinder constituted by a minor diameter cylinder portion and a major diameter cylinder portion;

a stepped piston received in said stepped cylinder and constituted by a minor diameter piston portion and a major diameter piston portion adapted to be fitted in said minor diameter cylinder portion and said major diameter cylinder portion respectively;

a working chamber defined between said minor diameter cylinder portion and said minor diameter piston portion;

an annular sub-intake chamber defined between said major diameter cylinder portion and said minor diameter piston portion;

a crankchamber connected to said major diameter cylinder portion;

a auxiliary carbureator connected to said annular sub-intake chamber through a check valve only allowing a fuel-air mixture to flow toward said sub-intake chamber;

a main carburetor connected to said crankchamber through a check valve only allowing a fuel-air mixture to flow toward said crankchamber; and a main scavenging passageway connecting said crankchamber with said working chamber;

wherein the improvement resides in setting said auxiliary carburetor and said main carburetor in such a manner that the former forms a mixture of fuel of high quality and air and the latter forms a mixture of fuel of low quality and air and providing said working chamber with not only a main scavenging port but also an auxiliary scavenging port, said auxiliary scavenging port being in communication with said sub-intake chamber through a super-charging reservoir, with a check valve only allowing a fuel-air mixture to flow toward said super-charging reservoir being mounted between said sub-intake chamber and said super-charging reservoir, said auxiliary scavenging port being formed in the position where said auxiliary scavenging port is opened and closed simultaneously with said main scavenging port by the movement of the minor diameter piston portion by the stroke of the piston, and the pressure at which the check valve mounted between said sub-intake chamber and said super-charging reservoir opens being set at a level at which the mixture flows from said sub-intake chamber to said super-charging reservoir after the piston blocks and auxiliary scavenging port.

2. A crankchamber precompression type two-cycle internal combustion engine as claimed in claim 1, wherein said check valve only allowing a fuel-air mixture to flow toward said sub-intake chamber is in the form of a piston valve constituted by a suction port and said major diameter piston portion.

3. A crankchamber precompression type two-cycle internal combustion engine as claimed in claim 1, wherein said auxiliary scavenging port is curved in the vicinity of said minor diameter cylinder portion and directed toward the spark gap of an ignition plug mounted in a combustion chamber above said working chamber.

* * * * *